US005888651A

United States Patent [19]

Hoyt et al.

[11] Patent Number: 5,888,651

[45] Date of Patent: Mar. 30, 1999

[54] COLORED BICOMPONENT FIBERS

[75] Inventors: Matthew B. Hoyt; Diane R. Kent, both of Arden; Charles F. Helms; Otto M. Ilg, both of Asheville, all of N.C.

[73] Assignee: BASF Corporation, Mt. Olive, N.J.

[21] Appl. No.: 916,797

[22] Filed: Aug. 25, 1997

[51] Int. Cl.[6] ..... D02G 3/00

[52] U.S. Cl. ..... 428/370; 428/373; 428/374

[58] Field of Search ..... 428/370, 373, 428/374

[56] References Cited

U.S. PATENT DOCUMENTS

| | | | |
|---|---|---|---|
| 2,989,798 | 6/1961 | Bannerman . | |
| 3,454,460 | 7/1969 | Bosley . | |
| 3,616,183 | 10/1971 | Brayford . | |
| 3,803,453 | 4/1974 | Hull | 428/373 |
| 3,903,348 | 9/1975 | Eskridge et al. . | |
| 3,969,559 | 7/1976 | Boe | 428/87 |
| 4,051,287 | 9/1977 | Hayashi et al. | 428/91 |
| 4,069,363 | 1/1978 | Segraves et al. | 428/374 |
| 4,117,194 | 9/1978 | Barbe et al. | 428/288 |
| 4,150,674 | 4/1979 | Yung | 428/288 |
| 4,163,078 | 7/1979 | Reinehr et al. | 428/373 |
| 4,185,004 | 1/1980 | Mathis | 260/45.8 |
| 4,377,651 | 3/1983 | Leininger | 524/101 |
| 4,439,487 | 3/1984 | Jennings | 428/397 |
| 4,473,617 | 9/1984 | van Leeuwen et al. | 428/373 |
| 4,732,809 | 3/1988 | Harris, Jr. et al. | 428/373 |
| 4,761,327 | 8/1988 | Hamano et al. | 428/220 |
| 4,950,541 | 8/1990 | Tabor et al. | 428/373 |
| 5,019,445 | 5/1991 | Sternlieb | 428/323 |
| 5,085,667 | 2/1992 | Jenkins | 8/539 |
| 5,108,820 | 4/1992 | Kaneko et al. | 428/198 |
| 5,125,818 | 6/1992 | Yeh | 425/131.5 |
| 5,162,074 | 11/1992 | Hills | 156/644 |
| 5,236,645 | 8/1993 | Jones | 264/78 |
| 5,344,297 | 9/1994 | Hills | 425/131.5 |
| 5,516,576 | 5/1996 | Haggard et al. | 264/211 |
| 5,549,957 | 8/1996 | Negola et al. | 428/92 |

FOREIGN PATENT DOCUMENTS

| | | |
|---|---|---|
| 0 356 100 | 2/1990 | European Pat. Off. . |
| 6-184863 | 11/1992 | Japan . |

OTHER PUBLICATIONS

Webster's Dictionary, p. 261 Date 1990.

Hawley's Condensed Chemical Dictionary, p. 301, Date 1993.

*Primary Examiner*—Newton Edwards

[57] ABSTRACT

Colored bicomponent filaments have a particulate colorant dispersed throughout one of the fiber domains while another of the fiber domains is colorant-free. More specifically, the filaments have at least two distinct components arranged longitudinally coextensive with one another. The arrangement of the components may be a sheath/core structure or a side-by-side structure. One of the components contains a colorant and the other one does not (i.e., is colorant free). The colorant-free component is most preferably formed of a polymeric material which is incompatible with the particulate colorant, whereas the colorant-containing component is most preferably formed of a polymeric material which is compatible with the particulate colorant.

19 Claims, 4 Drawing Sheets

COLORED BICOMPONENT FIBERS

FIELD OF THE INVENTION

The present invention relates generally to the field of bicomponent synthetic polymer fibers. More particularly, the present invention relates to colorant-containing bicomponent fibers.

BACKGROUND AND SUMMARY OF THE INVENTION

As used herein the term" bicomponent fiber" means a fiber having at least two distinct, and possibly more, components or domains in intimate adherence along their length. These components are distinct due to the polymer used and/or due to the additives present. The term "filament" means a fibrous strand of indefinite length. The term "staple" means a fibrous strand of short length. The term "fiber" means filaments, staple, or both. The colored bicomponent fibers of the present invention have Munsell Values between about 2.5/ to about 8.5 and Munsell Chromas greater than about/0.5. (Kelly et al, The ISCC-NBS *Method of Designating Colors and a Dictionary of Color Names*, National Bureau of Standards Circular 553, pages 1–5 and 16 (1955), incorporated hereinto by reference.) The term "colorant" means a solid particulate pigment which may be incorporated into a spinnable polymer to obtain colored filaments.

The incorporation of additives in so-called "neat" thermoplastic polymeric host materials (that is, polymeric materials containing no additives) so as to achieve desired physical properties is well known. Thus, the art has conventionally incorporated colorants, stabilizers, delusterants, flame retardants, fillers, antimicrobial agents, antistatic agents, optical brighteners, extenders, processing aids and other functional additives into polymeric host materials in an effort to "engineer" desired properties of the resulting additive-containing polymeric host material. Such additives are typically added any time prior to shaping of the polymeric material, for example, by spinning or molding (e.g., extrusion, injection, or blow-molding) operations.

The incorporation of colorant additives in filaments formed by melt-spinning a polymeric material has presented unique challenges. For example, the amount of particulate pigment dispersed in a concentrate which is added to the polymeric material must be sufficiently high to impart satisfactory color density, but must not be so high as to interrupt the spinning process. One prior proposal for incorporating colorant additives in thermoplastic polymeric materials is disclosed in U.S. Pat. No. 5,236,645 to Frank R. Jones on Aug. 17, 1993 (the entire content of which is expressly incorporated hereinto by reference).

According to the Jones '645 patent, additives are introduced into a thermoplastic melt by feeding at least one additive in an aqueous vehicle containing a dispersant to form an aqueous additive stream to a vented extruder which is extruding a thermoplastic. The aqueous portion of the aqueous additive stream is thereby volatilized within the extruder and is removed therefrom via an extruder vent. As a result, a substantially homogeneous system containing the thermoplastic, dispersant and the additive is obtained which may thereafter be spun into a filament by melt-extrusion through filament-forming orifices in a spinneret associated with a spin pack assembly.

Some colorants are known to be unsuitable for use with certain polymeric systems—for example, due to degradation of the colorants at the processing temperatures of the polymeric systems, the degradation of the colorants due to the chemical environment of the resin (e.g., reductive nature of many polymeric melts) or the abrasiveness of the colorant per se or a combination of these three phenomena. Thus, it would be highly desirable if synthetic polymeric fibers could be provided which are colored by the incorporation of colorants which, until now, have not been considered potential colorant candidates for such purpose. It is towards fulfilling such a need that the present invention is directed.

Broadly, the present invention provides colored bicomponent filaments wherein the colorant is dispersed throughout one of the fiber domains while another of the fiber domains is colorant-free. The colorant-containing component will most preferably occupy between about 10 to about 90% of the fiber cross-section, while the colorant-free domain will occupy between about 90 to about 10% of the fiber cross-section. The colorant-free domain will cover at least about 50% of the fiber's outer surface, and most preferably will cover the entirety of the fiber's outer surface so that it encapsulates or surrounds entirely the colorant-containing domain.

BRIEF DESCRIPTION OF THE ACCOMPANYING DRAWINGS

In the discussion which follows, reference will be made to the accompanying drawing FIGS. 1 and 2 which are graphs of reflectance (%) versus wavelength (nm) of fabrics made from the fibers of Examples 1–4 and 9–12, respectively.

FIGS. 3 and 4 are exemplary ISCC-NBC color-name charts.

DETAILED DESCRIPTION OF THE INVENTION

Figure 1:
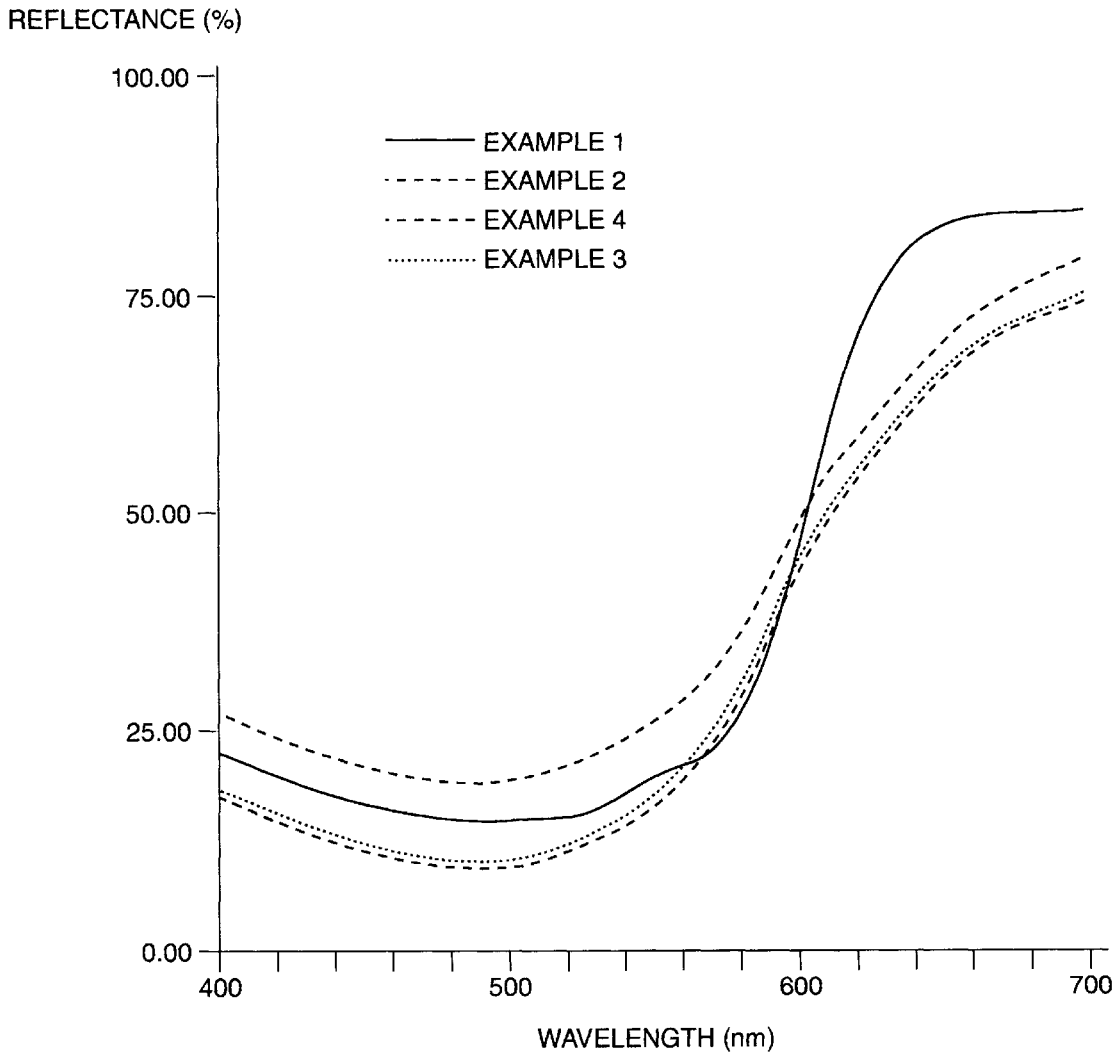

To promote an understanding of the principles of the present invention, descriptions of specific embodiments of the invention follow and specific language describes the same. It will nevertheless be understood that no limitation of the scope of the invention is thereby intended, and that such alternations and further modifications, and such further applications of the principles of the invention as discussed are contemplated as would normally occur to one ordinarily skilled in the art to which the invention pertains.

The present invention provides colored bicomponent filaments wherein the colorant is dispersed throughout one of the fiber domains while another of the fiber domains is colorant-free. More specifically, the present invention provides a filament having a least two distinct components arranged longitudinally coextensive with one another. The arrangement of the components may be a sheath/core structure or a side-by-side structure. One of the components contains a colorant and the other one does not (i.e., is colorant free).

Regardless of whether the components are arranged sheath/core or side-by-side, the colorant-free component should occupy at least 50% of the external surface of the fiber. More preferably, the colorant-free component will occupy more than 50% of the external surface of the fiber so that the colorant-containing component is at least partially encapsulated thereby. Most preferably, the colorant-free component entirely encapsulates the colorant-containing component (i.e., the colorant-free component occupies 100% of the external surface of the fiber) so that the fiber is a sheath/core structure—namely, having the colorant-containing component as the core which is surrounded entirely by a colorant-free sheath. The core may be centered (concentric) or offset (acentric). Furthermore, the fiber cross-section may be round or may be non-round, for example, a trilobal cross-sectional configuration.

Virtually any melt-spinnable polymer may be employed in the practice of the present invention. Classes of suitable polymeric materials include polyamides, polyesters, acrylics, olefins, maleic anhydride grafted olefins, and acrylonitriles. More specifically, nylon (especially nylon-6 or nylon 6,6), polyolefins (such as polypropylene, polyethylene and the like) and polyesters are especially preferred.

The distinct fiber components may be formed of the same class of polymeric material or may be formed of different classes of polymeric materials. In any event, as noted previously, one of the components will contain a colorant, while the other component will be colorant-free. In a particularly preferred embodiment, the fibers of this invention are symmetrical sheath/core structures whereby the colorant-free sheath is formed of a nylon (e.g., nylon-6) and the colorant-containing core is formed of polypropylene.

The colorants employed in the present invention may be virtually any solid particulate colorant. The colorant will most preferably be insoluble in the colorant-containing polymeric material at its processing conditions (but dispersible therein) and compatible therewith (e.g., no subject to degradation at processing conditions of the colorant-containing polymeric material). Moreover, the colorant is most preferably one which is incompatible with the polymeric material forming the fiber's colorant-free domain—e.g., in terms of adverse reactions occurring between the polymeric material of the colorant-free domain and the colorant and/or colorant degradation at the polymeric material's processing conditions (e.g., temperatures). Thus, according to the present invention, such particulate colorants may be dispersed in a compatible polymeric material (e.g., polypropylene) and formed into a core component of a bicomponent fiber which is surrounded by a sheath component formed of a polymeric material (e.g., nylon) which is incompatible with the colorant. Most preferably, the colorants are particulate organic pigments.

Some advantages, however, also ensue from incorporating a colorant in an incompatible polymeric material and then providing such a mixture as a core of a sheath/core bicomponent fiber. That is, even though some adverse chemical reactions and/or colorant degradation may be experienced, by surrounding the colorant-incompatible polymeric material with a sheath component, such reactions and/or colorant degradations are significantly minimized.

Thus, for example, the fibers of the present invention exhibit improved UV light resistance and bleachfastness. As used herein, and in the accompanying claims, the terms "UV light resistance" and "bleachfastness" are meant to refer to a bicomponent filament having a colorant-containing and colorant-free domains which, in the case of UV light resistance after 1275 kilojoules of UV light exposure, and in the case of bleachfastness after exposure to the bleachfastness test to be described in greater detail below, respectively have a CIE La*b* total color difference relative to unexposed filaments at least 50% as compared to the total color difference when subjected to the same conditions of a monocomponent filament which consists only of a polymeric material which is the same as the polymeric material forming the colorant-free domain of the bicomponent filament, but having the same overall colorant loading homogeneously dispersed therein as the colorant-containing domain of the bicomponent filament.

The bleachfastness test that is employed according to the present invention refers to the testing of knitted flat jersey fabrics which are cut into a 4"×4" square. The fabric is then completely immersed in a 100 ml. solution of 5.25% sodium hypochloride in water. After the fabric is completely wetted out, excess solution is blotted off and the fabric is hanged for 24 hours at 70° F. and 65% relative humidity. The fabric is then rinsed in a mild detergent, rinsed with water and dried for an additional 24 hours. Color changes are then measured using a spectrophotometer under D5000 daylight illumination. Total color difference is recorded using the CIE La*b* system relative to the unbleached fabric.

The particulate colorants are incorporated into the colorant-containing polymeric component in any amount required to achieve the desired filament coloration. Preferably, however, the colorant will be present in the colorant-containing component in an amount of at least about 0.005 wt. %, and more preferably between about 0.05 wt. % to about 0.10 wt. %. The amount of the colorant present will depend in large part upon the particular colorant that is selected and the particular color of the filament that may be desired.

The particulate colorants must, of course, be spinnable with the polymeric materials in which they are incorporated. That is, the colorants must not be so large in size that they clog or block the spin plate orifices (thereby causing spinning breaks). Thus, for most applications, the particulate colorants will have a mean particle size of less than about 10 $\mu$m, preferably less than about 5 pLm, and will typically be between about 0.1 $\mu$m to about 2 $\mu$m.

The ratio $C_c$:$C_f$ of the colorant-containing component to the colorant-free component, respectively, can vary within wide ranges. For example, the ratio $C_c$:$C_f$ is preferably less than about 90:10 and typically about 70:30.

The filaments of this invention may be usefully employed in a number of end-use applications. For example, the filaments of this invention may be formed into textile fabrics (e.g., apparel fabrics, household fabrics and the like) according to techniques well known in this art. Furthermore, the filaments may be formed into carpet yarns, in which case a trilobal sheath/core structure is particularly preferred. More specifically, fibers for the purpose of carpet manufacturing have linear densities in the range of about 3 to about 75 denier per filament (dpf) (denier=weight in grams of a single fiber with a length of 9000 meters), and typically between about 15–25 dpf.

The invention will be further illustrated by way of the following Examples which disclose specific embodiments of this invention, but which are non-limiting with respect thereto.

EXAMPLES

The present invention will be further illustrated and understood from the following non-limiting Examples.

Example 1

40 grams of 25% by weight concentrate of Red 194 (Rhodafin Red RRN-AE 30 from Hoechst-Celanese Corporation of Charlotte, N.C.) in polyethylene was combined with 1960 grams of polypropylene. This mixture was placed in the extruder that supplies the core of the fibers. Temperatures in the core extruder zones were 165° C., 180° C., 200° C., 220° C. and 240° C. The polymer line between the extruder and the polymer metering gear pump was heated to 240° C. Nylon 6 (2.7 relative viscosity, bright, BS-700F from BASF Corporation, of Mt. Olive, N.J.) was placed in the sheath extruder. Temperatures in the sheath extruder zones were 245° C., 265° C., 270° C., and 275° C. The polymer line between the extruder and the polymer metering gear pump was heated to 275° C. as was the spin beam that held the metering pumps and the spin pack. The speed of the polymer metering gear pumps was adjusted such that about 20% of the core mixture was delivered to the core of each filament and the remaining 80% was the nylon 6 sheath. The sheath and core polymers were directed through a 56 filament spin pack similar to that described in U.S. Pat. No. 5,344,297 to Hills so as to produce a fiber cross section similar to that illustrated in FIG. 16 therein (i.e., a sheath-core trilobal fiber). The 56 filament yarn subsequently had a lubricating oil applied, and was thereafter processed through three pairs of heated, driven rolls. The first pair of rolls was operated at 80° C. and 500 meters per minute. . The second pair or rolls was operated at 130° C. and 510 meters per minute. . The final pair of rolls was operated at 140° C. and 1597 meters per minute. The yarn was then taken up on a tension controlled winder. In a subsequent step, the yarn was heated and textured (or "bulked").

No difficulties were seen in spinning the yarn. As extruded, the yarn had a clear red appearance.

Example 2

The conditions of Example 1 were repeated except the core component was nylon 6 (BS-700F) instead of polypropylene. Also, the core extruder temperatures were 245° C., 255° C., 265° C., 270° C., and 275° C.; and the polymer line was heated to 275° C.

No difficulties were seen in spinning the yarn. As extruded the yarn had a slight blue overtone to the red color which became a purer red as the yarn sat overnight.

Example 3 (Comparative)

Example 2 was repeated except the nylon 6 in the core extruder contained no colorant and the sheath extruder used a mixture of 40 grams of the 25% concentrate of Red 194 (i.e., as described in Example 1) in 7,960 grams of nylon 6. The resulting yarn contained 0.1 wt. % of the colorant per linear length of the yarn.

No difficulties were seen in spinning the yarn. As extruded, the yarn had a slight blue overtone to the red color which became a purer red as the yarn sat overnight. Color seemed darker and a little browner when later examined.

Example 4 (Comparative)

Example 2 was repeated except the mixtures used in both the core and sheath extruders was 40 grams of the 25% concentrate of Red 194 (i.e., as described in Example 1) in 9,960 grams of nylon 6. The resulting yarn contained 0.1 wt. % of the colorant per linear length of the yarn.

No difficulties were seen in spinning the yarn. As extruded, the yarn had a slight blue overtone to the red color which became a purer red as the yarn sat overnight. Color seemed darker and a little browner when later examined. Overall appearance of this yarn was very similar to that in Example 3.

Example 5

Example 1 was repeated except the core mixture was 4 grams of the Red 194 concentrate in 1996 grams of polypropylene.

Example 6

Example 2 was repeated except the core mixture was 4 grams of the Red 194 concentrate in 1996 grams of nylon 6.

Example 7 (Comparative)

Example 3 was repeated except the sheath mixture was 4 grams of the Red 194 concentrate in 7,996 grams of nylon 6.

Example 8 (Comparative)

Example 4 was repeated except the mixture for both extruders was 4 grams of the Red 194 concentrate in 9,996 grams of nylon 6.

Example 9

Example 1 was repeated except the core mixture was 200 grams of the Red 194 concentrate in 1800 grams of polypropylene.

Example 10

Example 2 was repeated except the core mixture was 200 grams of the Red 194 concentrate in 1800 grams of nylon 6.

Example 11 (Comparative)

Example 3 was repeated except the sheath mixture was 200 grams of the Red 194 concentrate in 7,800 grams of nylon 6.

Example 12 (Comparative)

Example 4 was repeated except the mixture for both the core and sheath extruders was 200 grams of the Red 194 concentrate in 9,800 grams of nylon 6.

The yarns from Examples 1–12 above were knitted into single jersey circular knit fabrics. These fabrics were mounted on cards and accelerated weathering was performed as suggested in AATCC procedure 16—1987 (option E). The tensile properties of the unexposed and weathered yarns were determined using the procedure given by ASTM D 2256. The resulting data appears in Table 1 below.

TABLE 1

Effect of accelerated weathering on tensile properties

| | Tenacity (grams force per denier) | | | | | Breaking Elongation (percent extension) | | | | |
|---|---|---|---|---|---|---|---|---|---|---|
| Weathering | unexposed | 425 | 850 | 1275 | 2125 | unexposed | 425 KJ | 850 KJ | 1275 Kj | 2125 KJ |
| Example 1 | 2.36 | 1.73 | 1.64 | 1.05 | 0.34 | 43.6 | 43.1 | 36.3 | 22.1 | 8.8 |
| Example 2 | 2.18 | 1.72 | 1.35 | 0.80 | 0.02 | 44.1 | 48.7 | 29.6 | 16.7 | 3.3 |
| Example 3 | 2.52 | 1.29 | 1.14 | 0.42 | 0.04 | 52.5 | 28.9 | 22.4 | 10.6 | 4.4 |
| Example 4 | 2.63 | 1.39 | 1.23 | 0.83 | 0.07 | 43.7 | 29.8 | 24.8 | 16.2 | 5.3 |
| Example 5 | 2.73 | 1.42 | 1.10 | 0.41 | untestable | 57.0 | 34.3 | 23.8 | 9.7 | untestable |
| Example 6 | 2.08 | 1.44 | 1.27 | 0.41 | untestable | 43.0 | 36.9 | 30.5 | 10.5 | untestable |

TABLE 1-continued

Effect of accelerated weathering on tensile properties

| | Tenacity (grams force per denier) | | | | | Breaking Elongation (percent extension) | | | | |
|---|---|---|---|---|---|---|---|---|---|---|
| Weathering | unexposed | 425 | 850 | 1275 | 2125 | unexposed | 425 KJ | 850 KJ | 1275 Kj | 2125 KJ |
| Example 7 | 2.41 | 1.61 | 1.13 | 0.22 | untestable | 54.2 | 36.7 | 22.9 | 7.5 | untestable |
| Example 8 | 2.40 | 1.76 | 1.47 | 0.67 | untestable | 47.9 | 35.0 | 24.7 | 13.6 | untestable |
| Example 9 | 2.44 | 1.83 | 1.67 | 1.30 | 0.60 | 39.4 | 55.6 | 43.8 | 30.8 | 14.1 |
| Example 10 | 2.28 | 1.74 | 1.42 | 0.85 | 0.15 | 52.4 | 53.4 | 42.7 | 18.8 | 7.4 |
| Example 11 | 2.27 | 1.05 | 1.00 | 0.50 | 0.11 | 48.0 | 21.7 | 20.1 | 10.6 | 7.0 |
| Example 12 | 2.53 | 1.11 | 0.95 | 0.65 | 0.28 | 49.1 | 24.1 | 18.6 | 13.9 | 8.8 |

"untestable" means that the yarn had degraded so badly that it could not be mounted in tensile testing equipment.

A spectrophotometric measurement of the exposed and unexposed materials was made and the total color difference between the exposed and unexposed materials was calculated under the CIE L*a*b* system. (For details of these calculations see, for example, Billmeyer, Principles of Color Technology, $2^{nd}$ edition (1981), expressly incorporated hereinto by reference.) Color measurement is calculated for D5000 daylight illumination. The lower the value of the total color difference (ΔE) the less the color of the material has changed for a typical observer. The values of the total color difference for the four degrees of weathering are given in Table 2.

TABLE 2

Total Color Difference After Accelerated Weathering
Color Change of Fabric Relative to Unexposed Fabric

| | 425 KJ | 850 KJ | 1275 KJ | 2125 KJ |
|---|---|---|---|---|
| Example 1 | 2.05 | 2.41 | 1.91 | 3.19 |
| Example 2 | 18.42 | 19.65 | 19.55 | 19.76 |
| Example 3 | 34.75 | 44.41 | 45.61 | 49.88 |
| Example 4 | 34.58 | 43.41 | 44.84 | 48.67 |
| Example 5 | 13.75 | 13.8 | 7.18 | 6.21 |
| Example 6 | 10.85 | 11.49 | 9.98 | 9.01 |
| Example 7 | 26.47 | 28.15 | 22.8 | 22.21 |
| Example 8 | 27.72 | 29.07 | 21.52 | 20.8 |
| Example 9 | 0.6 | 1.1 | 1.58 | 2.92 |
| Example 10 | 4.96 | 2.79 | 4.83 | 4.16 |
| Example 11 | 5.95 | 7.02 | 8.6 | 9.56 |
| Example 12 | 3.46 | 3.88 | 5.14 | 5.8 |

Two different effects are believed to be seen in this data. The first effect seen is the loss of the colorant as the weatherometer exposure degrades the colorant. The second effect that is seen is the "browning" of the fibers (especially Examples 3, 4, 7, 8, 11, and 12) due to a degradation mechanism while the pigment was at high temperature and exposed to air as the fibers left the spin pack and is revealed with a loss of the red colorant.

Figure 2:
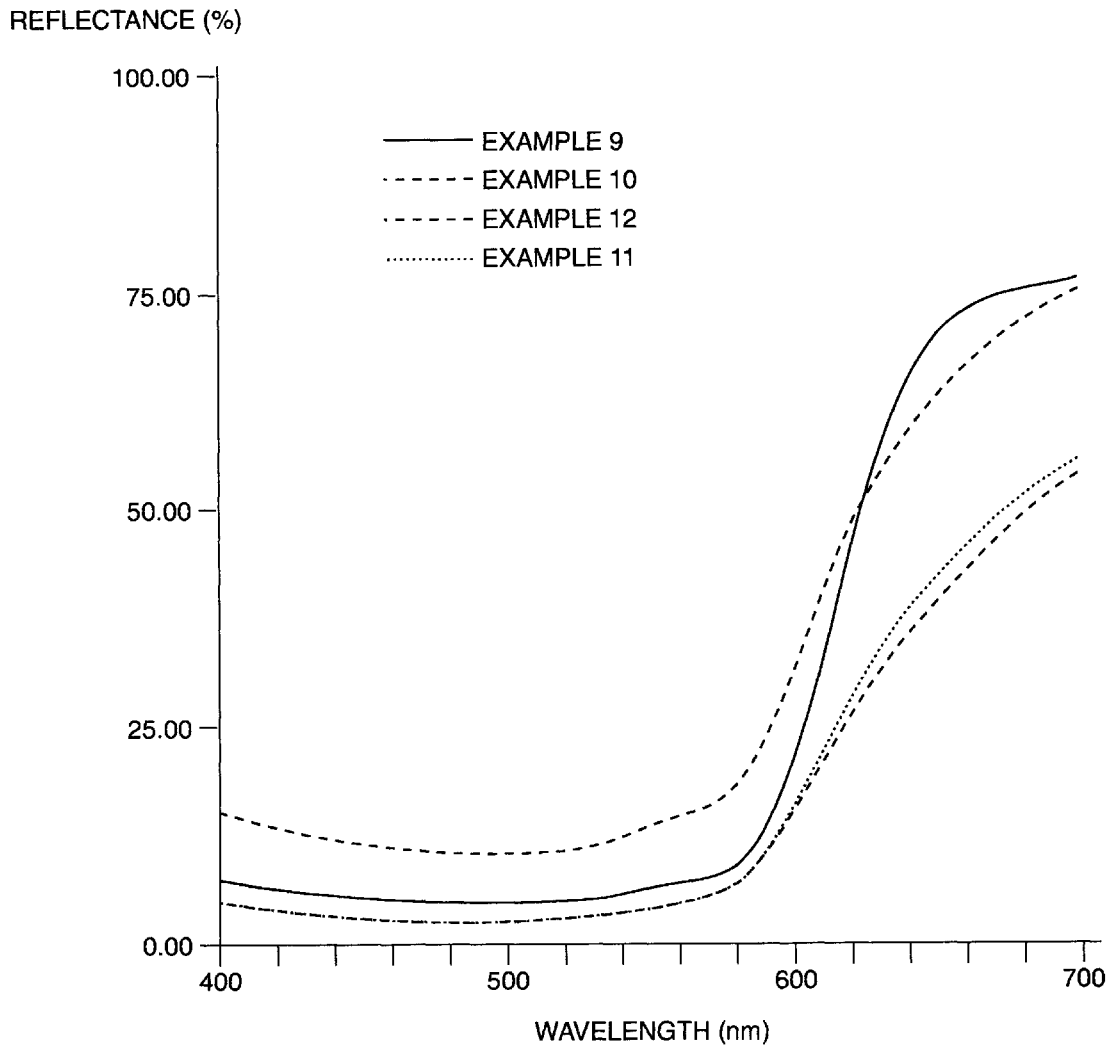
Figure 3:
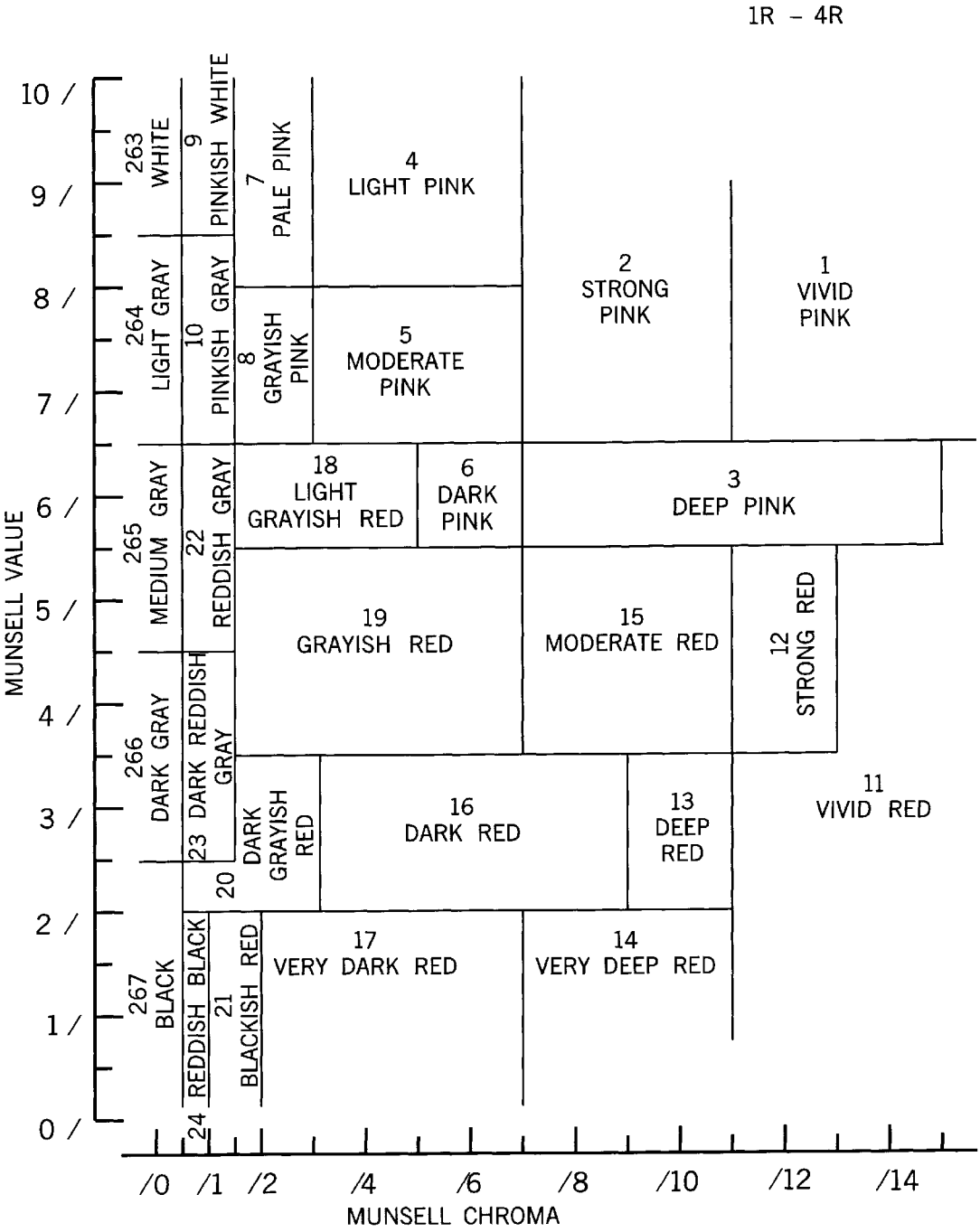
Figure 4:
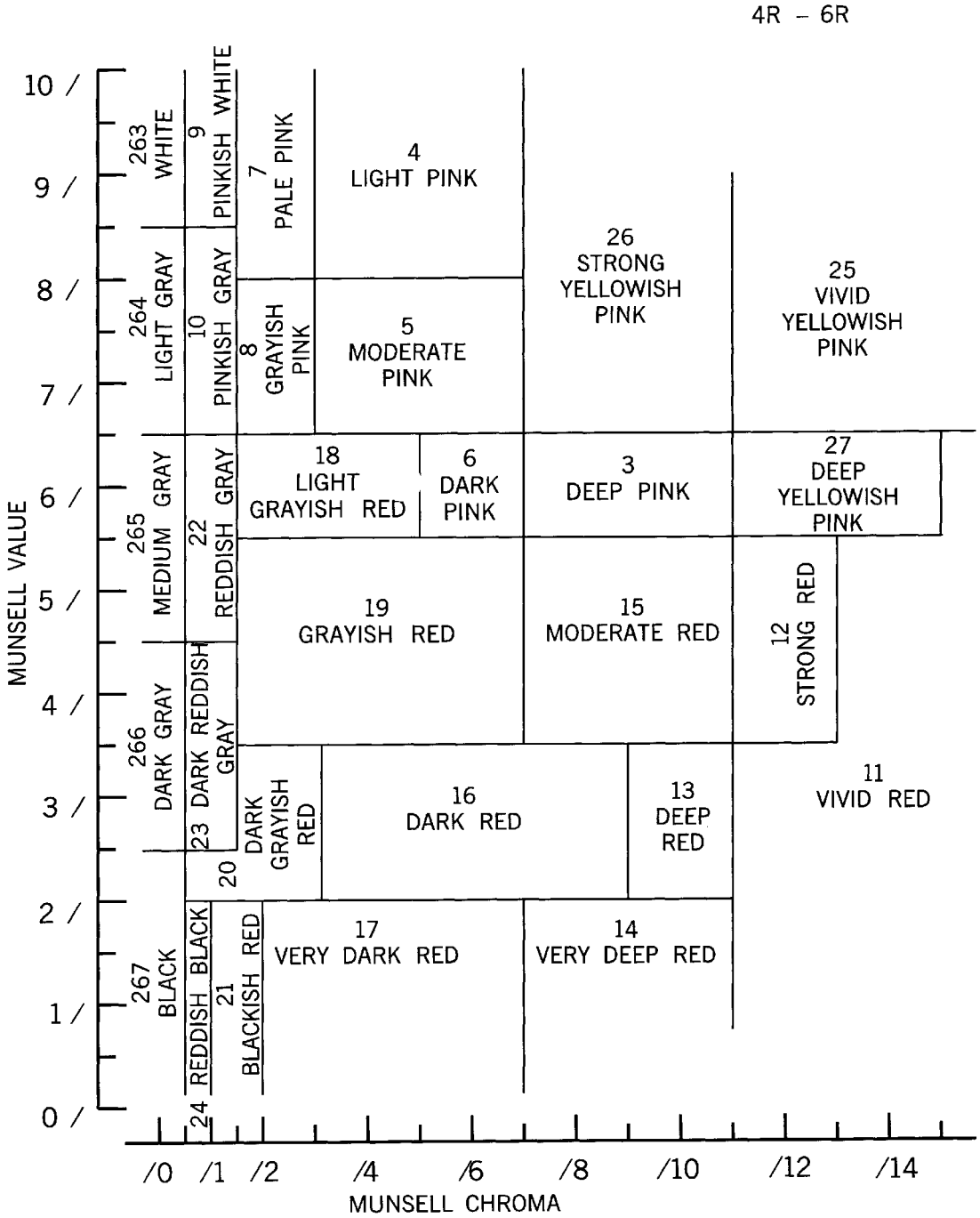

Accompanying FIGS. 1 and 2 are graphs of the reflectance values of the fabrics made from Examples 1–4, and 9–12, respectively. The curves are created from measurements performed at every 20 nm of the visible spectrum from 400 to 700 nm. The different characteristics of the appearance of the pigment to the polymer matrix and position in the fiber can be seen.

Example 13

200 grams of a bleach sensitive yellow pigment concentrate (C.l. Pigment Yellow 150) was mixed with 4600 grams of polystyrene (PS 2820 from BASF Corporation, Mount Olive N.J.). That mixture is extruded into the 25% by weight core of a trilobal carpet yarn (58 filaments 1300 denier). Extrusion temperatures for the core extruders are 170° C., 185° C., 223° C., and 245° C. Polymer lines and the spin beam are all maintained at 270° C. Sheath polymer is uncolored nylon 6 (BS-700F from BASF Corp. of Mount Olive, N.J.). The sheath extruder temperatures are 240° C., 250° C., 260° C., 265° C., and 270° C.

Example 14

200 grams of a bleach sensitive yellow pigment concentrate, C-005, is mixed with 19,000 grams of nylon 6 (BS-700F from BASF Corporation of Mount Olive N.J.). That mixture is extruded into a 58 filament 1300 denier trilobal carpet yarn. The extruder temperatures are 240° C., 250° C., 260° C., 265° C., and 270° C. All polymer lines are maintained at 270° C.

When the yarns form Examples 13 & 14 knitted into single knit jersey fabrics and exposed to bleach Example 13 has no significant color change. The fabric from Example 14 turns from a bright yellow to a very dull appearing gray color.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A colored bicomponent polymeric filament comprising:

(a) a particulate colorant insoluble with, but dispersed throughout, a colorant-containing polymeric domain, and (b) a colorant-free polymeric domain that is longitudinally coextensive with said colorant-contaning polymeric domain, wherein said colorant-containing polymeric domain is formed of a polymeric material which is compatible with said colorant and said colorant-free polymeric domain is formed of a polymeric material which is incompatible with said colorant, and wherein the color of said colored bicomponent filament has a Munsel value from about 2.5/ to about 8.5/ and a Munsell chroma greater than /0.5.

2. The filament of claim 1, in the form of a sheath/core filament in which said colorant-containing polymeric domain is the core of said filament and said colorant-free polymeric domain is the sheath of said filament.

3. The filament of claim 2, wherein said filament is a trilobal filament.

4. The filament of claim 1, 2 or 3, wherein said colorant-containing polymeric domain is formed of polypropylene, and said colorant-free polymeric domain is formed of nylon.

5. The filament of claim 1, wherein said colorant-containing and colorant free polymeric domains are selected from the group consisting of polyamides, polyesters, acrylics, olefins, maleic anhydride grafted olefins and acrylonitriles.

6. The filament of claim 1, wherein the colorant-free component occupies more than 50% of the external filament surface.

7. The filament of claim 1, wherein the colorant-free component entirely encapsulates the colorant-containing component.

8. The filament of claim 7, wherein the colorant-containing component is asymmetrically disposed within said colorant-free component.

9. The filament of claim 7, wherein the colorant-containing component is symmetrically disposed within said colorant-free component.

10. The filament of claim 1, wherein the colorant includes a organic pigment.

11. A colored bicomponent polymeric filament comprising: (a) a particulate colorant insoluble with, but dispersed throughout, a colorant-containing polymeric domain and (b) a colorant-free polymeric domain that is longitudinally coextensive with said colorant-containing polymeric domain, wherein said filament has a UV light resistance after exposure to 1275 kJ UV light, as determined by a CIE La*b* total color differences, that is no more than 50% of the CIE La*b* total color difference of a monocomponent filament formed of the same polymeric material as that of the colorant-free domain, but having the colorant homogeneously dispersed therein.

12. A colored bicomponent polymeric filament comprising: (a) a particulate colorant insoluble with, but dispersed throughout, a colorant-containing polymeric domain and (b) a colorant-free polymeric domain that is longitudinally coextensive with said colorant-containing polymeric domain, wherein said filament has a bleachfastness as determined by a CIE La*b* total color difference that is no more than 50% of the CIE La*b* total color difference of a monocomponent filament formed of the same polymeric material as that of the colorant-free domain, but having the colorant homogeneously dispersed therein.

13. A colored bicomponent filament comprising:

a colorant-containing polymeric core; and a colorant-free polymeric sheath, wherein said colorant-containing core contains a particulate colorant dispersed therein in sufficient amount to impart a desired color to said filament and wherein said particulate colorant is insoluble, but compatible, with said colorant-containing polymeric core, but incompatible with said colorant-free polymeric sheath, and wherein the color of said colored bicomponent filament has a Munsell value from about 2.5/ to about 8.5/ and a Munsell chroma greater than /0.5.

14. The filament of claim 13, wherein said filament is a trilobal filament.

15. The filament of claim 12 or 14, wherein said colorant-containing polymeric core is formed of polypropylene and said colorant-free polymeric sheath is formed of nylon.

16. The filament of claim 13, wherein said colorant-containing core and said colorant-free polymeric sheath are selected from the group consisting of polyamides, polyesters, acrylics, olefins, maleic anhydride grafted olefins, and acrylonitriles.

17. A colored bicomponent fiber comprising:

(a) a colorant-containing polymeric core, and (b) a colorant-free polymeric sheath, wherein said colorant-containing polymeric core contains a particulate colorant dispersed therein in sufficient amount to impart a desired color to said filament and said particulate colorant is insoluble, but compatible, with said colorant-containing polymeric core, but incompatible with said colorant-free polymeric sheath and wherein said colored bicomponent fiber has a UV light resistance after exposure to 1275 kJ UV light. as determined by a CIE La*b* total color difference, that is no more than 50% of the CIE La*b* total color difference of a monocomponent filament formed of the same polymeric material as that of the colorant-free domain, but having the colorant homogeneously dispersed therein.

18. A colored bicomponent fiber comprising:

(a) a colorant-containing polymeric core; and (b) a colorant-free polymeric sheath, wherein said colorant-containing polymeric core contains a particulate colorant dispersed therein in sufficient amount to impart a desired color to said filament and said particulate colorant is insoluble, but compatible, with said colorant-containing polymeric core, but incompatible with said colorant-free polymeric sheath and wherein said colored bicomponent fiber has a bleachfastness as determined by a CIE La*b* total color difference that is no more than 50% of the CIE La*b* total color difference of a monocomponent filament formed of the same polymeric material as that of the colorant-free domain, but having the colorant homogeneously dispersed therein.

19. The filament of claim 13, wherein the colorant is an organic pigment.

* * * * *